US007181943B2

(12) United States Patent
Seidel

(10) Patent No.: US 7,181,943 B2
(45) Date of Patent: Feb. 27, 2007

(54) DESCALING METHOD FOR STRIP-ROLLING MILL

(75) Inventor: Jürgen Seidel, Kreuztal (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 368 days.

(21) Appl. No.: 10/469,378

(22) PCT Filed: Feb. 23, 2002

(86) PCT No.: PCT/EP02/01927

§ 371 (c)(1),
(2), (4) Date: Aug. 27, 2003

(87) PCT Pub. No.: WO02/070157

PCT Pub. Date: Sep. 12, 2002

(65) Prior Publication Data

US 2004/0069034 A1 Apr. 15, 2004

(30) Foreign Application Priority Data

Mar. 3, 2001 (DE) ..... 101 10 324

(51) Int. Cl.
*B21B 45/06* (2006.01)

(52) U.S. Cl. ..... 72/39; 72/40; 72/236

(58) Field of Classification Search ..... 72/39, 72/40, 41, 42, 43, 44, 45, 8.5, 201, 236, 10.2; 29/81.03, 81.01–81.17
See application file for complete search history.

(56) References Cited

U.S. PATENT DOCUMENTS 3,779,054 A * 12/1973 Greenburger ..... 72/12.2
4,745,786 A * 5/1988 Wakako et al. ..... 148/504
5,036,689 A * 8/1991 Sekiya et al. ..... 72/39
5,235,840 A 8/1993 Blazevic
5,502,881 A * 4/1996 Gaydoul ..... 29/81.08
5,517,842 A * 5/1996 Ginzburg ..... 72/8.5
5,661,884 A * 9/1997 Thomas ..... 29/81.08
6,089,069 A * 7/2000 Seidel et al. ..... 72/236
6,134,933 A * 10/2000 Yamamoto et al. ..... 72/201
6,257,034 B1 * 7/2001 Fukumori et al. ..... 72/39
6,389,666 B1 * 5/2002 Grothe ..... 29/81.08

FOREIGN PATENT DOCUMENTS

| | | |
|---|---|---|
| DE | 199 38 705 | 2/2001 |
| EP | 0 920 929 | 6/1999 |
| JP | 01205810 | 8/1989 |
| JP | 03110010 | 5/1991 |
| JP | 11319904 | 11/1999 |

* cited by examiner

*Primary Examiner*—Dmitry Suhol
(74) *Attorney, Agent, or Firm*—Andrew Wilford

(57) ABSTRACT

Strip is descaled in a rolling line having a scale scrubber and a finishing line downstream of the scale scrubber. The strip is sprayed with water on its upper and under sides at a descaling pressure in the scale scrubber. In the scrubber the strip is treated with water at a multiplicity of locations spaced from one another in the travel direction. A furthest downstream location at the under side is spaced downstream from a furthest downstream location at the upper side. Rolling torques of at least one rolling mill of the finishing line are measured above and below the strip and control parameters are produced corresponding thereto. These parameters are fed to a control circuit and used thereby to adjust quantities of water sprayed at the locations against the upper side and under side of the strip upstream of the finishing line.

4 Claims, 3 Drawing Sheets

DESCALING METHOD FOR STRIP-ROLLING MILL

Figure 1:
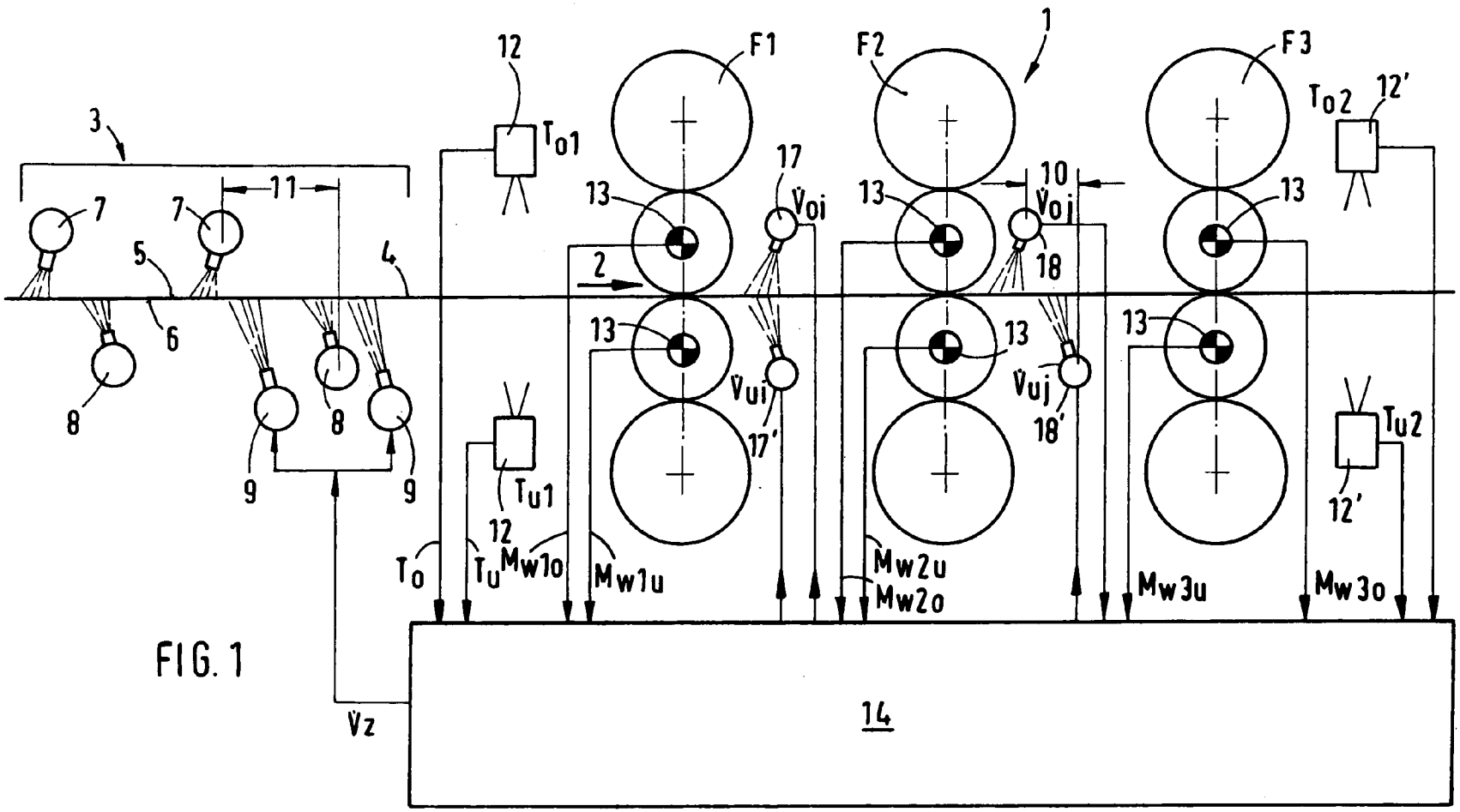

The invention relates to a method for the descaling of strip in a rolling-mill line with a scale washer and, arranged in the travel direction of the strip downstream of the scale washer, a finishing line in which water impinges upon the strip in the scale washer as well as in the rolling line from the upper and lower sides.

In the operation of hot strip rolling lines the rolling in of secondary scale can be observed on the strip surfaces. By "scale" is to be understood an oxide layer which forms upon the strip inter alia upon rolling. The development of the scale depends substantially upon the surface temperature of the strip, the scaling time, the environmental conditions and the material of the strip. An increased surface temperature, a longer scaling duration and softer steels bring with them a stronger scale development.

In order to avoid wear of the working rolls of the mill stands of a finishing line as a result of the development of scale, it is proposed in U.S. Pat. No. 5,235,840, to arrange for between-stand cooling between individual mill stands of the finishing line, whereby the surface temperature of the strip can be controlled to be held within a defined range. The scale washer arranged ahead of the finishing line in the direction of travel of the web is comprised of spray heads in pairs directed oppositely against both sides of the strip.

In finish rolling in a hot strip rolling line, EP 0 920 929 A2 proposes to reduce the development of scale by providing, in the travel direction of the strip, ahead of the first, second and third rolling stands of the finish line respective service cooling, each of which comprises oppositely directed nozzle rows trained upon the two sides of the strip. A control determines the total amount of water which is sprayed from each nozzle array upon the strip. The scale scrubber which is arranged in the travel direction of the strip ahead of the finishing line is comprised of two rows of nozzles arranged opposite one another on the two opposite sides of the strip.

In the scale scrubber upstream of the finishing line, the strip is treated with water with a hot descaling before (about 200 bar). By the impingement of water against the strip from opposite sides, thermal energy is obstructed from the strip. As a result of different conditions on the upper and lower sides, unequal temperatures arise there. Because of the laws governing the development of the scale described at the outset, the scale development begins directly downstream of the nozzle beam anew, in the directed direction, whereby because of the different temperatures at the strip surfaces, the secondary scale develops at different rates. Apart from this, because of the nonuniform temperatures, the scale has different hardnesses.

As a consequence of temperature differences and scale differences, there is a sliding roll effect which results in a vibration in the mill stands of the finishing line or a ski formation at the strip heads. In addition the moments developed in the mill stand can have different levels in the regions of the upper and lower rolls. The aforementioned problems cannot be fully compensated by the features proposed by the state of the art.

The invention thus presents as its object the provision of a method which reduces the detrimental effects of different temperatures as well as of different scale development between the upper and lower sides of the strip within the finishing line.

The solution of this object rests upon the concept of avoiding nonuniform temperatures or scale development already at the scale scrubber in that a symmetrical temperature distribution is produced already there at the upper and lower sides of the strip. As a consequence symmetrical conditions prevail so that the drawbacks in the finishing line are avoided.

Advantageously the symmetrical temperature distribution is brought about between upper and lower sides of the strip in that the strip is imparted in the scale scrubber at a multiplicity of locations one after another in the travel direction with water at the descaling pressure whereby the last point of such impingement of water on the underside is spaced from the last point of impingement of water at the upper side and is located closer to the finishing line than the last point of impingement on the upper side. The treatment of the strip with water at the different locations is effected, for example, by means of nozzle rows which are themselves known. The distance of the last nozzle row at the underside from the last nozzle row on the upper side which is selected, depends on the difference in the cooling effects at the upper and lower sides and upon the scale development of the rolled material in the respective rolling line.

By providing a distance between the last nozzle row at the underside and at the upper side to compensate for the temperature difference, the underside can be treated in an embodiment of the invention in total with a greater water quantity under the descaling pressure than the upper side of the strip. A smaller spacing between the two last nozzle rows can be required by structural considerations. It is however, also effective to avoid an altogether too large a thickness of the scale layer on the upper side of the strip. Tests have demonstrated that the water quantity at the underside should constitute about 60% to 80% and especially 70% of the total water quantity directed by means of the nozzle rows onto the underside and upper side of the strip in the scale scrubber.

To reduce the energy cost associated with greater water quantities at descaling pressure, in an embodiment of the invention, as an alternative, an additional cooling can be provided on the underside of the strip with water at a reduced pressure in the range between four bar and 10 bar. It will be self-understood that this feature can also be enhanced by that according to claim 3.

In an advantageous refinement of the invention, the treatment with water at a lower pressure is carried out in the travel direction of the strip upstream and/or downstream of the last location at the underside of the strip at which the latter is treated with water at the descaling pressure.

The water quantities required for a symmetrical temperature distribution depends upon the inlet speed of the strip upstream of the finishing line, the wear of the descaling nozzles in the nozzle rows, the pressure level and the width of the strip upstream of the finishing line, the wear of the descaling nozzles in the nozzle rows, the pressure level and the width of the strip.

To match the system to changing boundary conditions in the rolling line, the quantities of the water applied at the descaling pressure and the lower pressure to the strip are preferably adjustable.

In an advantageous embodiment of the invention, the symmetrical temperature distribution between the upper and lower sides of the strip is monitored in that contactless temperature measuring devices, for example parameters, are arranged especially downstream of the descaling scrubber in the travel direction of the strip to "measure the temperature at the upper and lower sides of the strip.

The amounts of water under lower pressure especially can be so varied as a controlled parameter of a control circuit so that the same temperatures sides. Alternatively rolling torques it can be measured above will always measured at the upper and lower or in addition to the temperatures, the rolling torques at least one mill stand of the finishing line can be measured above and below the strip.

To support the effect at the scale scrubber, in a refinement of the invention, it is provided that the strip at least between the first two mill stands of the finishing line be treated with water whereby the underside is treated in total with a greater water quantity than the upper side. Here as well the arrangement of upper and lower beams can be offset by the distance y from one another.

These features within the finishing line also can also be mounted with the aid of a control circuit with which the measured temperature at the upper and lower sides of the strip can be controlled parameters and the supplied water quantities can be controlled parameters.

In the following, the invention is described in greater detail with respect to FIGS. They show FIG. 1 a diagram illustrating the principles of the method of the invention, FIG. 2 a side view of a scale scrubber in a rolling line, and FIG. 3 a side view of a scale scrubber in a rolling of additional cooling.

FIG. 1 shows a finishing line 1 with a scale scrubber 3 arranged upstream of the finishing line 1 in the travel direction 2 of a hot strip rolling line. The strip 4 traveling through the hot strip rolling line is treated in the scale scrubber 3 on its upper side 5 and 6 underside 6 with water under a descaling pressure of about 200 bar from a total of 4 nozzle rows 7, 8.

REFERENCE CHARACTER LIST

1. Finishing line
2. Travel Direction of the strip
3. Scale Scrubber
4. Strip
5. Upperside
6. Lowerside
7. Nozzle row (descaling pressure)
8. Nozzle row (descaling pressure)
9. Nozzle row (low pressure)
10. Distance y
11. Distance x
12, 12' Pyrometer.
13. Measurement Points
14. Computer
15. Apparatus Data
16. Nozzle rows within the finishing line
17, 17' Nozzle rows within the finishing line
18,18' Nozzle rows within the finishing line The last nozzle row 8 on the underside 6 in the travel direction 2 is located closer to the section line than the last nozzle row 7 on the upperside 5 in order to produce a symmetrical temperature distribution on the upper and lower sides 5, 6 of the strip 4. These features are supported by two further nozzle rows 9 located in the travel direction ahead of and behind the last nozzle row 8 whereby the nozzle rows 9 treat the underside of the strip with water under a low pressure of about 4 to 10 bar. The water quantities which are applied to the underside 6 by means of the nozzle rows 9 are adjustable.

The distance 11 between the last nozzle row 7 on the upper side of the strip and the last nozzle row 8 on the lower side of the strip is basically so determined that the cooling effect on the upper side 5 of the strip corresponds to that one the underside 6. The spacing 11 can, however, on structural grounds, for example, the spatial requirements of the scale scrubber be limited by the arrangement of roll or pipes. For this reason, the cooling on the underside 6 of the strip is supported by the cooling from the nozzle rows as at low pressure. Finally, an excessive spacing 11 is disadvantageous since, as a result of the longer path from the last nozzle row 7 on the upperside 5 to the inlet to the finishing line 1, a scaled layer which is thicker over all can form on the upper surface.

The effectiveness of the cooling as a consequence of descaling by means of the nozzle rows 7, 8 and the additional cooling by the nozzle rows 9 are monitored by pyrometers 12 arranged at the upper and lower sides 5,6 upstream of the inlet to a first mill stand F1 of the finishing line or the pyrometer within the finishing line 12'. Finally at the first three mill stands F1 to F3 of the finishing line 1, the torques of the working rolls at the upper and lower spindles 13 are measured. The temperatures $T_o$, $T_u$ measured by the pyrometers 12 or 12' and the torques $M_{w1u\text{-}3u}$–$M_{w10\text{-}30}$ are fed as control parameters into a computer supported control circuit which influences as a controlled parameter the water quantity $V_z$ applied by the nozzle rows 9 or the water quantities $V_{oj}$, $V_{uj}$ and $V_{oi}$, $V_{ui}$ of the nozzle rows 18, 18' and 17, 17' so as to maintain the indicated symmetrical temperature distribution at the upper and lower sides 5,6 of the strip or the torque distributions. The nozzle rows 17, 17' or 18, 18' can be offset at a spacing 10. For adapting the computer to the respective production conditions, the apparatus data 15 and the process data 16 are read into the computer 14. The following adapting data are required for determining the requisite water quantity for the additional cooling via the nozzle rows 9 or for trimming the water quantity $V_{oi}$, $V_{ui}$ and $V_{oj}$, $V_{uj}$ of the nozzle rows 17, 17' and 18, 18' within the finishing line:

- the intake speed of the strip upstream of the finishing line 1 varies as a function of the finishing strip thickness and the strip material.
- the nozzles in the nozzle rows 7, 8 which undergo wear so that the water quantity changes with time.
- the pressure level in the supply network of the nozzle rows 7 varies,
- different widths of strip 4 influence the runoff of the water on the upper surface 5 of the strip 4.

Figure 2:
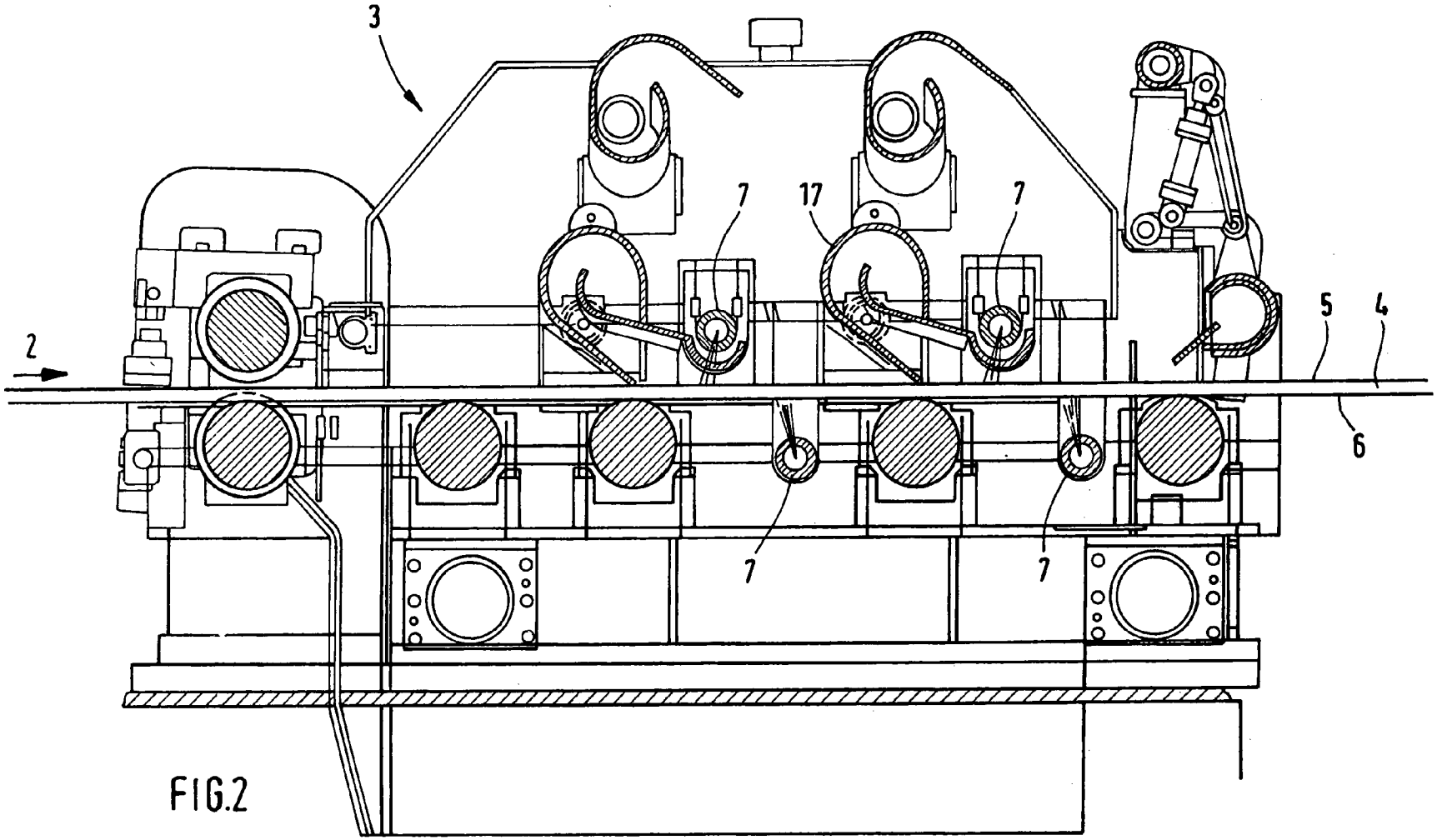
Figure 3:
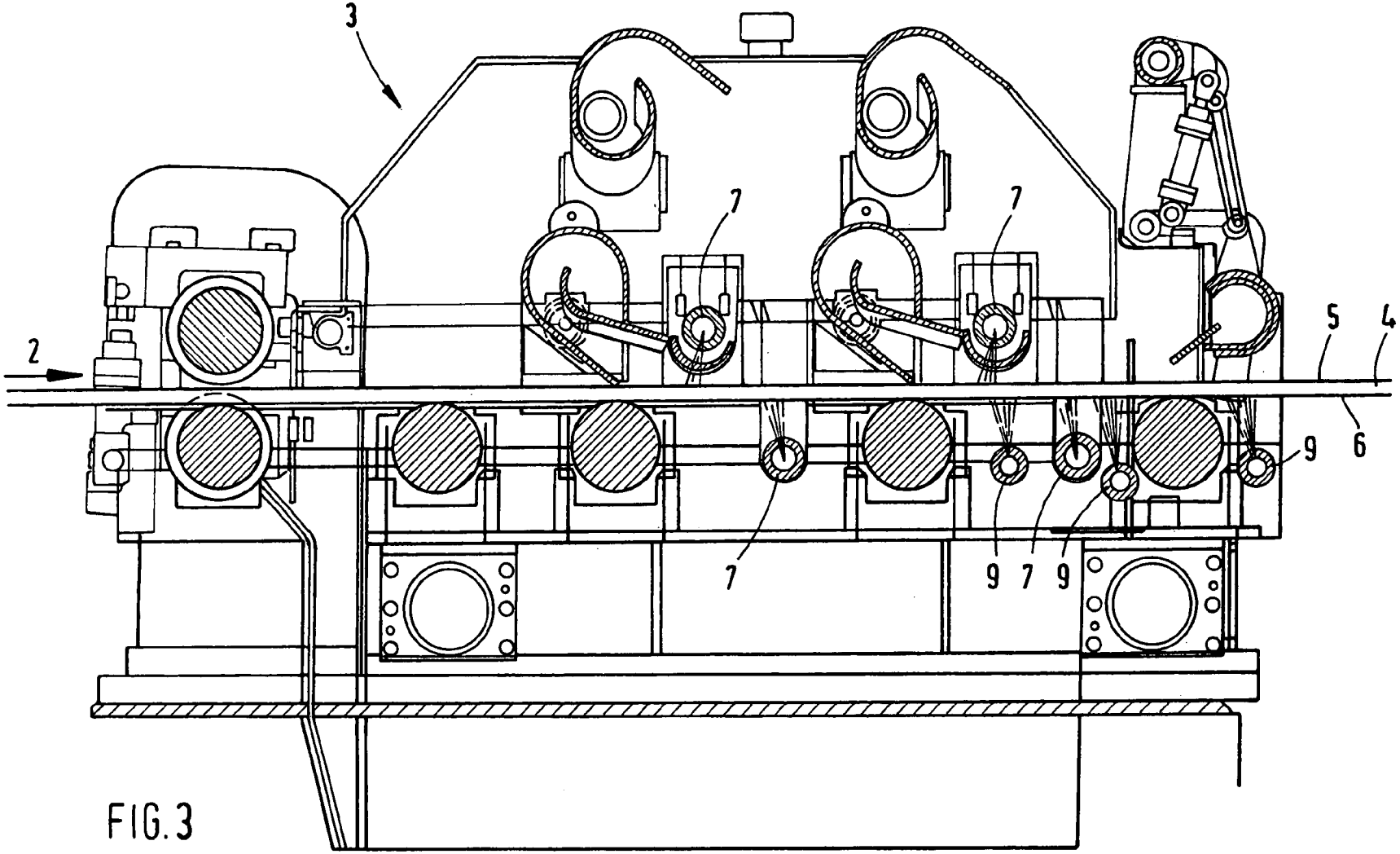

FIG. 2 shows in a schematic side view a scale scrubber 3 but without nozzle rows 9 for low pressure water. In this embodiment, the symmetric temperature distribution on the upper and lower sides 5, 6 of the strip is produced only by the spacing 11 of the offset arrangement of the last nozzle row 7 in the travel direction 2. Further from FIG. 2 it can be seen that on the upper side 5 of the strip so-called water collecting channels 17 are arranged which additionally reduce the cooling effect on the upper side 5 and can be used to a limited degree as control elements.

FIG. 4 shows finally a scale scrubber 3 with which the strip 4 is treated with water under reduced pressure by a nozzle row 9 upstream of the last nozzle row 7 on the last nozzle row 7 on the underside of the strip and two nozzle rows 9 downstream of the last nozzle row 7 and by means of which water at descaling pressure is applied.

The invention claimed is:

1. A method of descaling strip in a rolling line having a scale scrubber and a finishing line downstream of the scale scrubber in a travel direction of the strip, the strip being sprayed with water on its upper side and its under side at a descaling pressure in the scale scrubber as well as in the finishing line and being thereby cooled, a symmetrical temperature distribution between the upper and under sides being produced in the strip in the scale scrubber and maintained within the finishing line, characterized in that the strip is treated with water at a descaling pressure in the scale scrubber at a multiplicity of locations spaced from one another in the travel direction, a furthest downstream location at the under side is spaced downstream from a furthest downstream location at the upper side, rolling torques of at least one rolling mill of the finishing line are measured above and below the strip and control parameters are produced corresponding thereto, and the parameters are fed to a control circuit and used thereby to adjust quantities of water sprayed at the locations against the upper side and under side of the strip upstream of the finishing line, the strip being treated at least between first and second mill stands of the finishing line with water such that the under side is treated in total with a greater water quantity than the upper side of the strip.

2. The method according to claim 1, characterized in that the under side is treated, in addition to the water under descaling pressure, with water at a lower pressure in range between 4 and 10 bar.

3. The method according to claim 2, characterized in that the treatment with water at a lower pressure is effected in the travel direction of the strip upstream and/or downstream of the last location on the under side of the strip at which water at descaling pressure is applied.

4. The method according to claim 1, characterized in that the upper and lower beams are offset relative to one another.

* * * * *